US006652144B2

(12) United States Patent
Stefandl

(10) Patent No.: US 6,652,144 B2
(45) Date of Patent: Nov. 25, 2003

(54) BEVERAGE CONTAINER POUCH

(75) Inventor: Roland E. Stefandl, Princeton, NJ (US)

(73) Assignee: Super Chill Beverage Group Inc., Princeton, NJ (US)

( * ) Notice: Subject to any disclaimer, the term of this patent is extended or adjusted under 35 U.S.C. 154(b) by 0 days.

(21) Appl. No.: 10/078,870

(22) Filed: Feb. 19, 2002

(65) Prior Publication Data

US 2003/0156766 A1 Aug. 21, 2003

(51) Int. Cl.[7] ..... B65D 30/22

(52) U.S. Cl. ..... 383/38; 383/9; 383/113; 383/200; 383/104

(58) Field of Search ..... 383/109, 113, 383/116, 38, 200, 906, 9, 104

(56) References Cited

U.S. PATENT DOCUMENTS

| | | | | | |
|---|---|---|---|---|---|
| 2,992,118 | A | | 7/1961 | Daline | |
| 3,074,612 | A | * | 1/1963 | Schneider | 426/85 |
| 3,171,581 | A | * | 3/1965 | Kugler | 206/484 |
| 3,486,679 | A | | 12/1969 | Pfahler | |
| 3,520,471 | A | * | 7/1970 | Faust | 604/410 |
| 3,799,914 | A | | 3/1974 | Schmit et al. | |
| 4,454,979 | A | * | 6/1984 | Ikeda et al. | 383/10 |
| 4,557,377 | A | * | 12/1985 | Maloney | 206/219 |
| 4,806,021 | A | * | 2/1989 | Koudstaal et al. | 383/40 |
| 5,280,844 | A | | 1/1994 | Kaufman et al. | |
| 5,295,609 | A | | 3/1994 | Robbins, III | |
| 5,352,043 | A | * | 10/1994 | Takagaki et al. | 383/104 |
| 5,353,955 | A | | 10/1994 | Kaufman et al. | |
| 5,437,389 | A | | 8/1995 | Kaufman et al. | |
| 5,564,591 | A | | 10/1996 | Christine et al. | |
| 5,758,473 | A | * | 6/1998 | Patelli | 53/412 |
| 5,884,758 | A | * | 3/1999 | Sigouin et al. | 206/217 |
| 5,941,642 | A | | 8/1999 | Darmstadter | |
| 5,971,613 | A | * | 10/1999 | Bell | 383/107 |
| 6,039,720 | A | * | 3/2000 | Wieslander | 604/410 |
| 6,220,756 | B1 | | 4/2001 | Darmstadter | |
| 6,265,038 | B1 | * | 7/2001 | Frisk | 428/34.7 |

* cited by examiner

*Primary Examiner*—Jes F. Pascua
(74) *Attorney, Agent, or Firm*—Scully, Scott, Murphy & Presser

(57) ABSTRACT

A fluid container pouch is provided internally with a flexible straw to allow for the convenient and hygienic consumption of the beverage, or storage and use of other fluid materials. The fluid container pouch comprises at least first and second fluid chambers having at least two flow channels for fluid communication between said first and second fluid chambers. At least one of said flow channels comprises a flexible conduit, such as a flexible drinking straw. The fluid container pouch comprises two opposing pliable sidewalls, and the sidewalls are formed of a composite material, such as a polypropylene ply having a barrier layer of aluminum foil, a metalized coating, or polyethylene vinyl alcohol, on at least one side of said polypropylene ply.

14 Claims, 6 Drawing Sheets

BEVERAGE CONTAINER POUCH

BACKGROUND OF THE INVENTION

1. Field of Invention

The present invention is related generally to the field of packaging, and more particularly, to the packaging of liquids for convenient storage, transportation, and use.

More specifically, the present invention relates to a novel beverage container having a self-contained straw for ease of consumption.

2. Description of Related Art

The use of a pliable pouch to store fluids for convenient storage, transportation, and use is well known in the art. For example, such pouches may be used to store medical fluids for intravenous infusion to a patient; or for purified water or saline in a first aid kit. Such pouches are also used in conjunction with beverages designed for human consumption.

When used as a beverage container, the problem arises of how to open the package, and thereafter drink the beverage without spilling the contents. One common solution in the marketplace is to provide a wrapped straw with each beverage pouch, secured to the outside thereof. These straws are generally rigid, and have a sharpened point at one end. Some predetermined and appropriately designated weak point of the pouch is punctured with the sharpened point of the straw, allowing consumption of the beverage.

This arrangement has certain drawbacks. For example, the straw may become separated from the pouch prior to its intended use. For reasons of durability and preservation of the contents, so called barrier properties, such pouches are typically resilient, and difficult to tear open by hand. In that case, the package could only be opened with great force, likely spilling the contents in the process. Therefore, it would be inconvenient to consume the beverage if the straw were separated.

Even if not separated, the wrapper of the straw may become damaged, compromising its hygiene and that of the beverage when the straw is inserted into the pouch.

U.S. Pat. No. 3,799,914 issued to Schmit, et al., discloses a fluid pouch having a straw enclosed within it. However, to prevent fluid from flowing through the straw into an upper chamber, the straw must be sealed by means of a complex folding procedure. This would necessitate expenditure on labor or automated machinery to perform this task.

Further, the lower chamber must be sealed around the straw. In production, it would be common for the straw to be irreversibly sealed in the process, for example, when heat is applied to seal the pouch around the straw as described. Thereafter, the straw, and consequently the pouch, would be unusable.

Other beverage pouches known in the art are taught, for example, by Darmstadter, U.S. Pat. Nos. 5,941,641 and 6,220,756-B1. Darmstadter teaches the inclusion of a straw within the pouch, however the pouch has only one chamber, and the straw is merely a straight straw, not a flexible straw. Consequently, it extends very little beyond the pouch when opened, and is therefore relatively inconvenient to use.

Another beverage pouch containing a straw is taught by Christine, et al., U.S. Pat. No. 5,564,591. Again, this straw is straight, not flexible, and extends very little beyond the pouch when opened. It is likewise inconvenient to use.

Moreover with respect to Christine, the pouch requires the straw to be broken prior to use, and the pouch also requires a sealed fitment at an upper end of the straw.

BRIEF SUMMARY OF THE INVENTION

To overcome these and other difficulties in the prior art, disclosed is a fluid container pouch having a self-contained flexible drinking or dispensing straw.

A fluid container pouch according to the present invention comprises at least first and second fluid chambers having at least two flow channels for fluid communication between said first and second fluid chambers. At least one of said flow channels comprises a flexible conduit, such as a flexible drinking straw.

According to another aspect of the present invention, a fluid beverage pouch is formed between opposing pliable sidewalls made of a material consisting of a polypropylene ply having a barrier layer on at least one side.

In accordance with the present invention, a fluid container pouch is provided which is provided internally with a flexible straw. This allows for convenient and hygienic consumption of the beverage. This goal is further achieved while preventing fluid from pooling in an upper chamber where a distal portion of a flexible straw is held without the need for releasably sealing the straw in the packaging process, nor the risk of inadvertently permanently sealing the straw in the packaging process.

Further in accordance with the present invention, a beverage container pouch is provided which achieves suitable barrier properties as compared with currently used materials for such purposes at a significantly reduced cost.

BRIEF DESCRIPTION OF THE DRAWINGS

These and other features and advantages will become apparent from the following descriptions and drawings, where like numerals designate like features across the several figures.

DETAILED DESCRIPTION OF THE INVENTION

Figure 2:
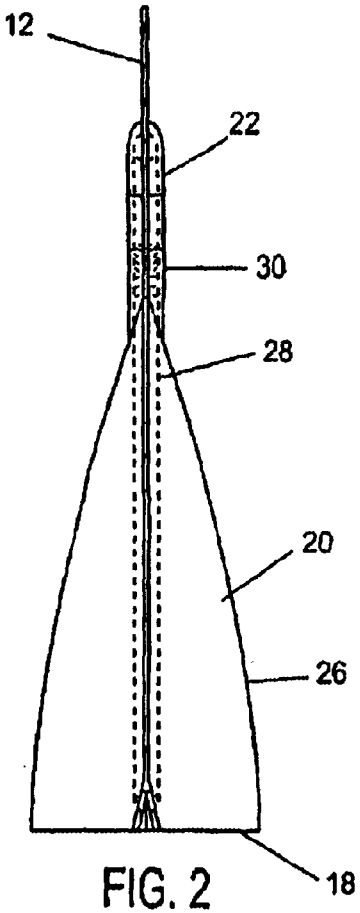
FIG. 2 shows a side elevation view of the filled pouch.
Figure 1:
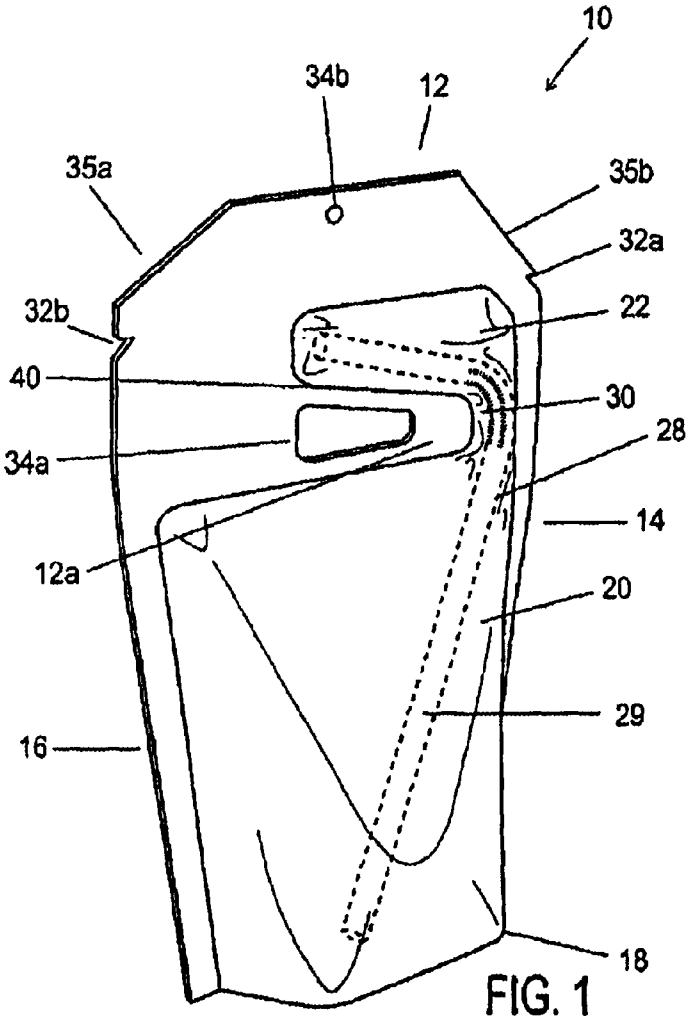
FIG. 1 shows a prospective view of a filled fluid container pouch according to the present invention.
Figure 5:
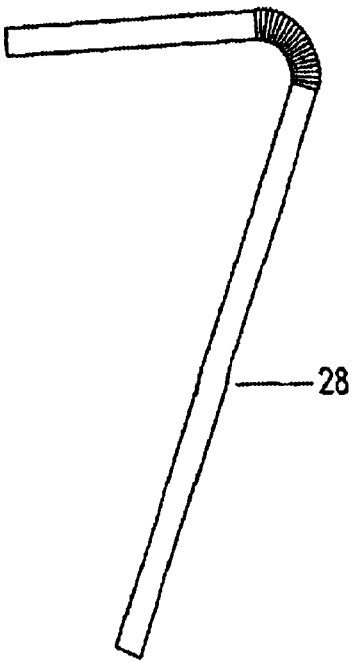
FIG. 5 illustrates the flexible drinking straw used in conjunction with an exemplary embodiment of the present invention.

Referring now to FIGS. 1 and 2, an exemplary embodiment of a filled fluid container pouch, generally 10, is illustrated. The pouch has an upper portion 12, two lateral side portions 14, 16, and a lower portion 18. First fluid chamber 20 and second fluid chamber 22 are provided between opposing pliable walls 24 and 26. First fluid chamber 20 and second fluid chamber 22 are generally separated by a margin 12*a* formed in upper portion 12.

A flexible conduit, for example a flexible drinking straw 28, is provided within the pouch 10 between the first chamber 20 and the second chamber 22, forming a first flow path therebetween. The flexible straw is unsealed, and provides a first flow path 29 allowing fluid communication between the first chamber 20 and the second chamber 22. A second flow path 30 also allows fluid communication between the second chamber 22 and the first chamber 20. In an exemplary embodiment, the second flow path 30 is coaxial with, and surrounds, the flexible straw 28. In an alternate embodiment, second flow path 30 is a one-way flow path permitting flow only from the second chamber 22 to the first chamber 20.

One or more design weaknesses, e.g. tear notches 32*a* and 32*b*, are provided at upper portion 12 to allow the pouch to be torn open by hand. One or more through holes 34*a* and 34*b* are provided in upper portion 12 to allow the pouch to be hung from a rack, for example in a retail store aisle or refrigerated case.

Figure 8:
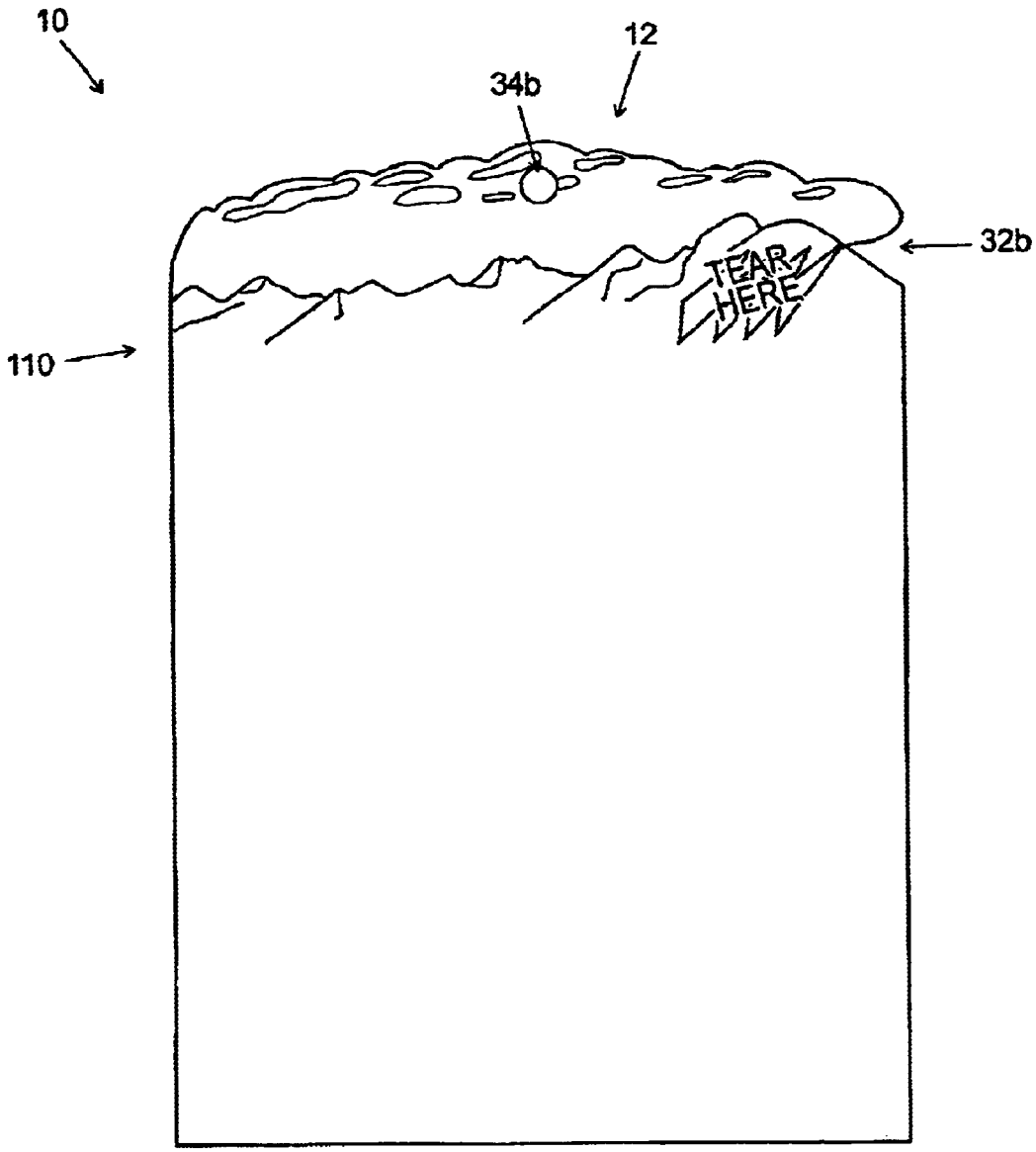
FIG. 8 shows one embodiment of the pouch bearing indicia.

Some portion of the pouch, upper portion 12 in the example of FIG. 1, can be formed in a non-rectangular fashion such as defined by edges 35*a*, 35*b*. One method of doing this would be a die-cut press, other methods are known in the art. These cuts can be varied to conform to indicia printed on either or both walls 24, 26 of the pouch. With reference to FIG. 8, in one exemplary embodiment, the indicia 110 include a scene having mountains with clouds above the mountains. The indicia 110 is printed on at least one wall, and the upper portion 12 of pouch 10 is die cut to the shape of the clouds. Notch 32*b* can be formed to match the indicia by a die-cut between a cloud above and a mountain slope below.

Figure 4:
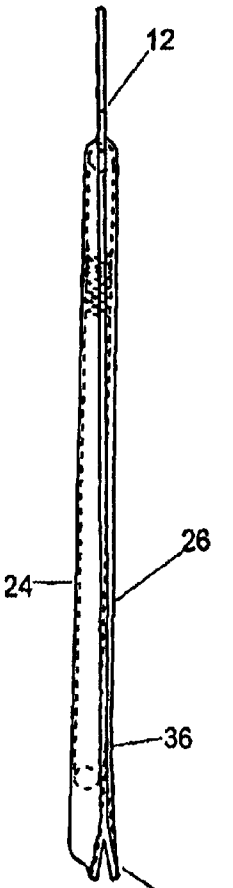
FIG. 4 shows a side elevation view of an unfilled fluid pouch.
Figure 3:
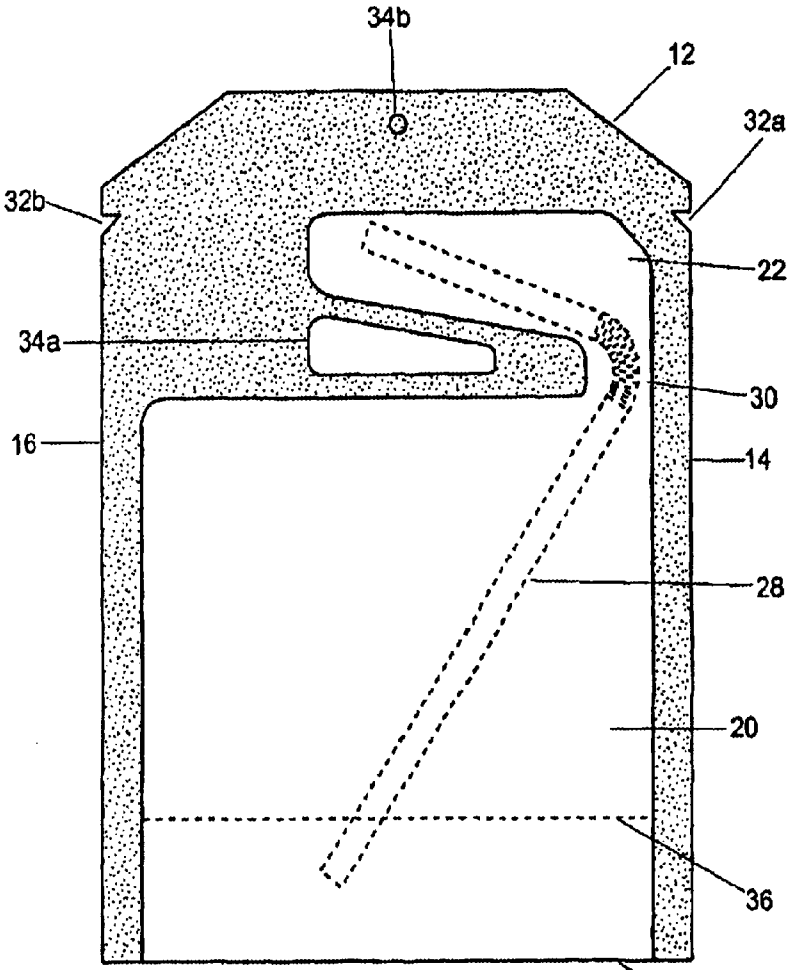
FIG. 3 shows a front elevation view of an unfilled fluid container pouch according to the present invention.

Referring now to FIGS. 3 and 4, the construction of the pouch will be described in more detail. Opposing pliable walls 24 and 26 can be formed either by joining two sheets of a suitable material together and sealing the same along the upper portion 12, both lateral portions 14, 16, and the lower portion 18. This can be accomplished either by heat-sealing, or any other suitable means known in the art. The flexibility of the pliable wall material will allow the first chamber 20 and second chamber 22 to form between opposing pliable walls 26 and 28 when filled with a liquid.

An alternative, and preferred construction is to fold a single sheet of the desired pouch material onto itself, and sealing along the upper portion 12, and both lateral portions 14, 16. More preferably, whether formed of two separate sheets or a single folded sheet, lower portion 18 is provided with at least one gusset 36 to allow expansion for additional fluid capacity, as well as to strengthen the seal at the lower portion 18. Additionally, either or both lateral portions may be provided with gussets irrespective of any gusset 36 at a lower portion.

Pouch 10 may be constructed from a single layer material or a multiple layer material. Materials commonly used for beverage pouches include a polyester ply sandwiched between layers of aluminum foil on either side.

A more preferable material that would allow reduced cost without sacrificing barrier properties is a polypropylene film ply 101 having an oxygen barrier layer 103 on one side only. The oxygen barrier layer 103 may be a metalized coating, an aluminum foil layer, a polyethylene vinyl alcohol layer, or other pliable material of suitable oxygen barrier properties known in the art.

This combination provides significant advantages. The oxygen barrier layer 103 supplements the oxygen barrier properties of the polypropylene. This is particularly important for carbohydrate-rich beverage liquids, where exposure to oxygen during shipment and storage adversely affects the contents' quality, even suitability for consumption. Furthermore, the above barrier properties can be realized at a reduced cost over the polyester material sandwiched between layers of aluminum foil as is commonly used.

Figure 7:
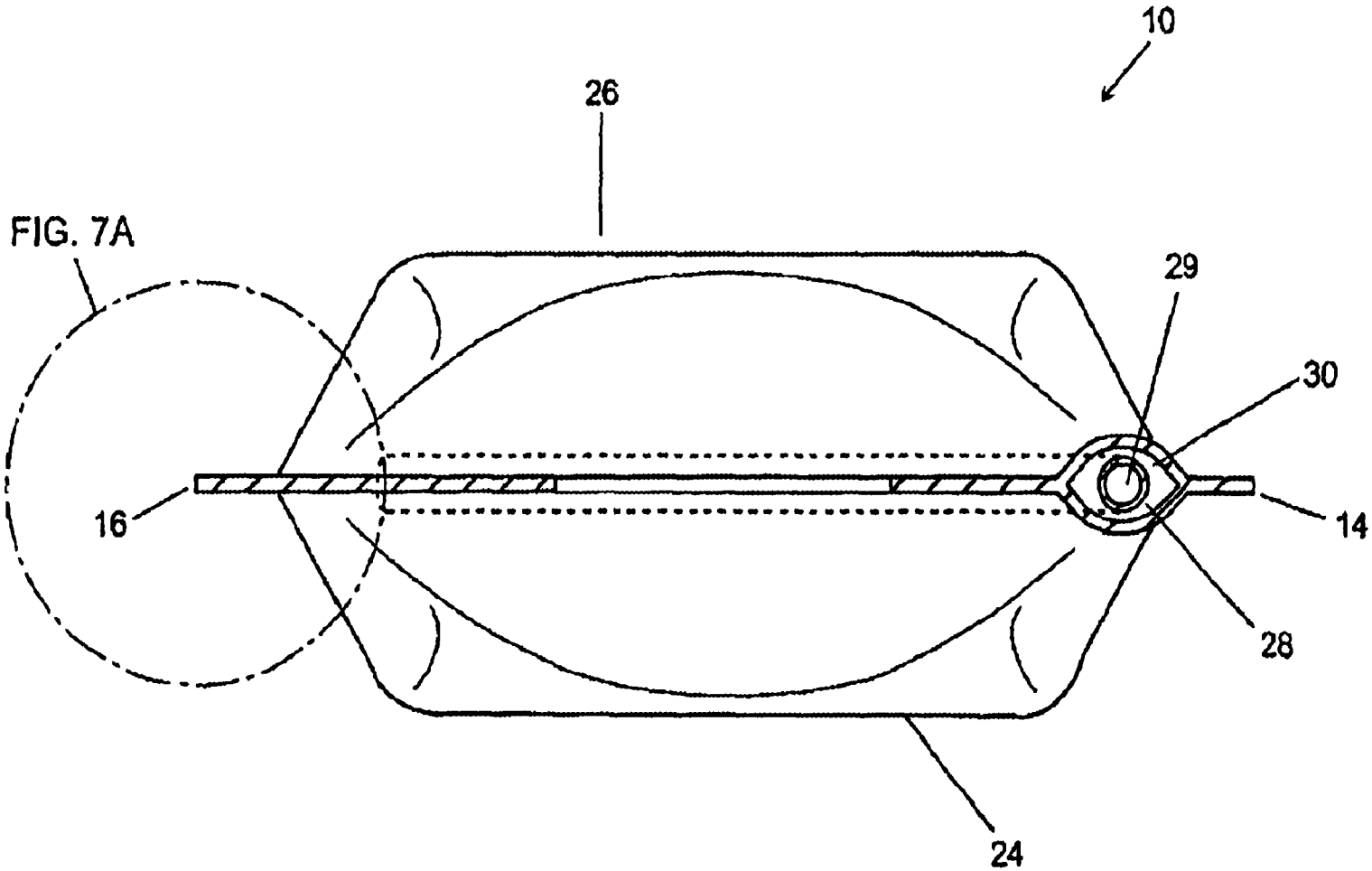
FIG. 7 shows a section view taken along line 7–7 of FIG. 6.
Figure 7A:
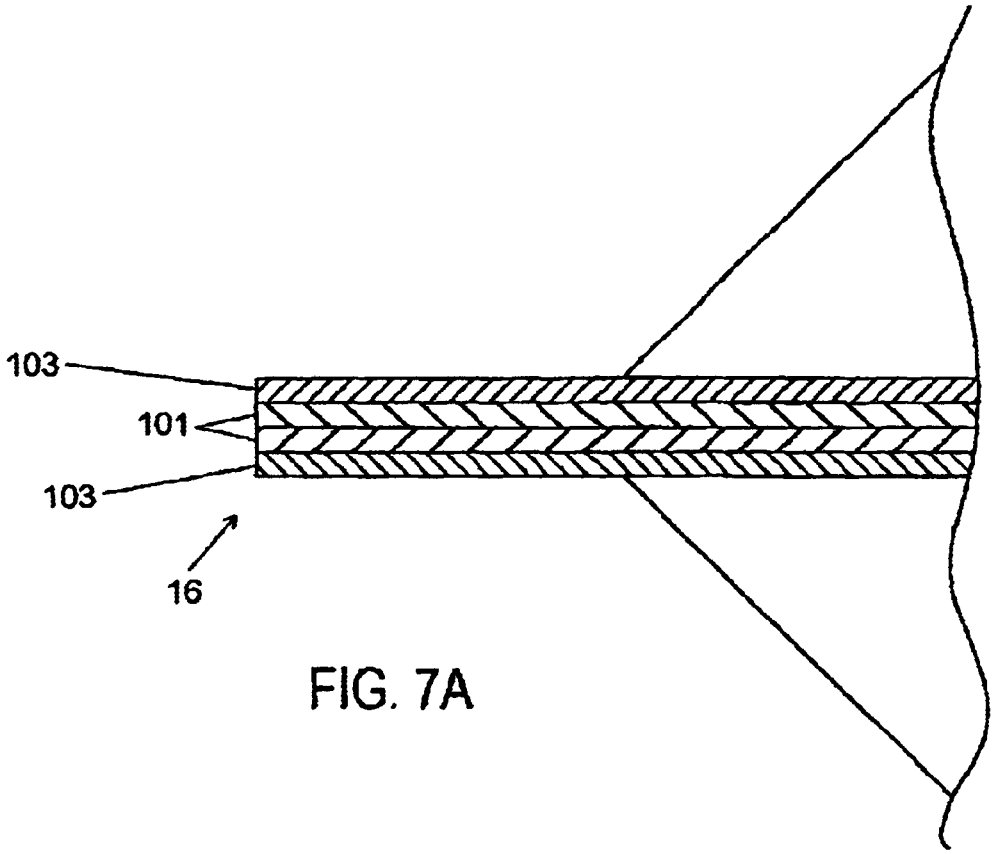
FIG. 7A shows the portion of FIG. 7 within circle 7A, enlarged and in additional detail.

With reference to FIG. 7A, the pouch 10 is preferably formed by orienting the oxygen barrier layer 103 outward. The outward facing barrier layer allows the superior moisture barrier properties of the polyethylene layer 101 to prevent contact between fluid contents of the pouch and the oxygen barrier layer, which could compromise the properties of the oxygen barrier layer 103. Pouch 10 may then be formed by folding a single sheet of such material in the manner described above.

The choice of barrier layer materials may be influenced by aesthetic concerns without departing from the scope of the present invention. For example, a pouch having an outwardly facing metalized or aluminum foil oxygen barrier layer will have a reflective outer surface, which would allow attractive and eye-catching indicia to be applied. Use of polyethylene vinyl alcohol for the oxygen barrier has the advantage of transparency, which could be combined with a transparent polypropylene layer to make the contents of the package visible.

Figure 6:
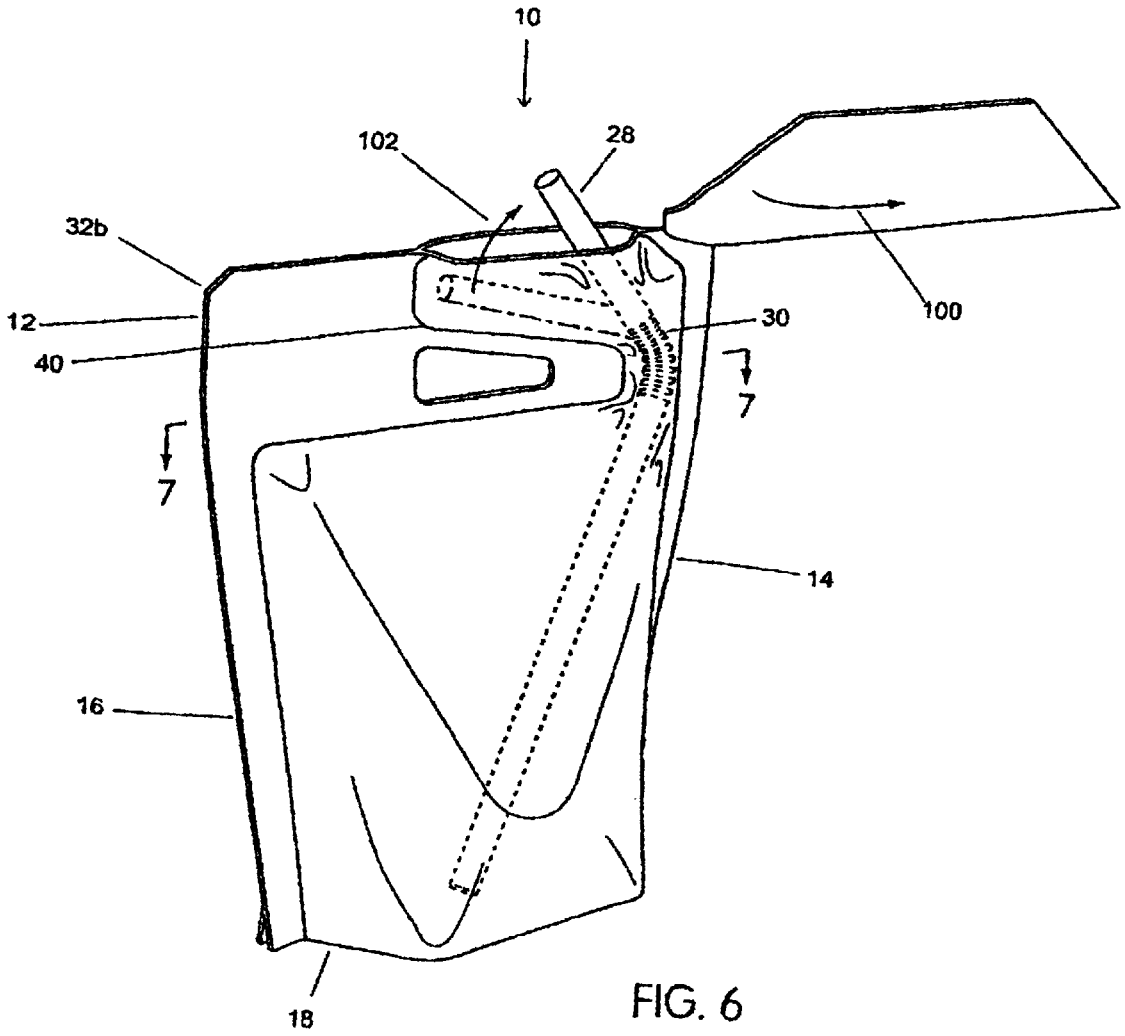
FIG. 6 shows a perspective view of a pouch according to the present invention after opening.

Referring now to FIGS. 1, 6 and 7, the use of the beverage container pouch will be described. In transportation and handling, the contents may flow via the flexible straw 28 between the first chamber 20 and the second chamber 22. It is, however, undesirable for fluid contents to be pooled in the second chamber when the pouch is opened. For this purpose, second flow path 30 allows for any fluid conducted into the second chamber 22 via flexible straw 28 to recycle back to the first chamber 20 under the influence of gravity via second flow path 30 when the package is placed in an upright orientation, for example when being opened. To aid in this recycling, a lower edge 40 of second chamber 22 can be angled to bias any fluid within the second chamber 22 towards the second flow path 30 and thereafter into the first chamber 20.

To open the pouch, a user would tear the upper portion 12, beginning at a designated weakness, for example notch 32*b*. Proceeding in the direction of arrow 100, the second chamber 22 would be opened. Flexible straw 28 may be biased in a manner that will cause it to rise in the direction of arrow 102 once chamber 22 is free of any downward constraints from upper portion 12. Therefore, an end of flexible straw 28 proximal to the user rises appreciably above the top of the pouch 10. The user may thereafter consume the beverage or otherwise use the contents.

In the case where flow path 30 is only a one-way flow path, the pouch may be inverted and/or squeezed for dispensing the contents. It is a further advantage to the present invention that providing the straw within the pouch, particularly across the diagonal dimension of the pouch as shown in the figures, enhances the structural stability of the pouch in all dimensions, particularly during handling and transportation.

The invention has been described herein with reference to particular exemplary embodiments. Certain alterations and modifications may be apparent to those skilled in the art, without departing from the scope of the invention. The exemplary embodiments are not meant to be limiting on the scope of the invention, which is defined by the appended claims.

To be secured by United States Letters Patent, what is claimed is:

1. A sealed fluid container pouch comprising:

a first enclosed fluid chamber;

a second enclosed fluid chamber generally separated from said first fluid chamber by a margin forming a lower edge of said second chamber, said second fluid chamber having its lowest point elevated above a maximum level of contents in said first fluid chamber; and at least two flow channels for fluid communication between said first and second fluid chambers, wherein a first one of said at least two flow channels comprises a drinking straw substantially traversing the entire combined height of the first and second fluid chambers.

2. The fluid container pouch according to claim 1 wherein said drinking straw comprises a flexible drinking straw.

3. The fluid container pouch according to claim 1 wherein an upper portion of said pouch comprises at least one through hole.

4. The fluid container pouch according to claim 1 further comprising one or more design weaknesses for allowing the pouch to be torn open.

5. The fluid container pouch according to claim 1 wherein at least one side of said second fluid chamber is angled to bias fluid flow towards a second one of said at least two flow channels.

6. The fluid container pouch according to claim 1 wherein said pouch includes at least one gusset for allowing the pouch to expand when filled.

7. The fluid container pouch according to claim 1 wherein a frontal profile of said pouch is formed in a non-rectangular shape.

8. The fluid container pouch according to claim 7 wherein said non-rectangular shape conforms to indicia on at least one wall of said pouch.

9. The fluid container pouch according to claim 1 wherein said pouch is formed from a single sheet of a pliable material folded onto itself and sealed along three sides.

10. The fluid container pouch according to claim 9 wherein said pliable material comprises a polypropylene ply and a barrier layer.

11. The fluid container pouch according to claim 10 wherein said barrier layer comprises an aluminum layer.

12. The fluid container pouch according to claim 10 wherein said barrier layer comprises a metalized coating.

13. The fluid container pouch according to claim 10 wherein said barrier layer comprises a polyethylene vinyl alcohol layer.

14. The fluid container pouch according to claim 10 wherein said barrier layer is oriented outwardly.

* * * * *